United States Patent [19]

Amrein

[11] Patent Number: 4,982,881

[45] Date of Patent: Jan. 8, 1991

[54] NOZZLE FOR A LIQUID CONTAINER

[76] Inventor: John E. Amrein, R.R. #1, Colgan, Ontario, Canada, L0G 1G0

[21] Appl. No.: 451,836

[22] Filed: Dec. 18, 1989

[51] Int. Cl.[5] ..... B67D 5/00

[52] U.S. Cl. ..... 222/514; 222/501; 222/518; 141/335; 141/351; 141/357

[58] Field of Search ..... 222/525, 523, 157, 162, 222/185, 481.5, 501, 518, 514, 568, 545; 141/295, 335, 344, 345, 351, 352, 353, 354, 355, 356, 357; 239/541, 579

[56] References Cited

U.S. PATENT DOCUMENTS

| | | | |
|---|---|---|---|
| 529,221 | 11/1894 | Wagner | 222/514 |
| 2,593,634 | 4/1952 | Vosburg | 222/525 |
| 3,074,444 | 4/1960 | Hawksford | 222/501 |

*Primary Examiner*—Andres Kashnikow

*Assistant Examiner*—Philippe Derakshani

*Attorney, Agent, or Firm*—Rogers, Bereskin & Parr

[57] ABSTRACT

A nozzle for a liquid container has first and second nozzle parts. The first nozzle part has a flange for engaging a collar to secure it to a container. A sealing member abuts the flange and includes a first sealing surface rebutting a neck of a container and a second sealing surface. A second nozzle part has an outlet opening and slidably engages the first nozzle part. A spring acts between the first and second nozzle parts to urge them apart. A valve member is secured to the second nozzle part and includes a closure member adapted to abut the second sealing surface under the action of the spring means to close the nozzle. The sealing member thus has a dual function, namely forming a seal with the neck of a container and forming a seal with the closure member.

20 Claims, 2 Drawing Sheets

NOZZLE FOR A LIQUID CONTAINER

FIELD OF THE INVENTION

This invention relates to a spout for fluid containers, and more particularly relates to a spout for a fluid container intended for containing gasoline or the like, and including a valve.

BACKGROUND OF THE INVENTION

At the present time, there are numerous machines powered by small gasoline engines, for example lawn mowers, chainsaws, garden cultivators, snow blowers, etc. Typically, the engines of such machines are provided with a small gas tank of reasonable capacity which will give a few hours' running time. In order to fill up the gasoline or fuel supply tank of the machine, the user usually has a separate container or can, which can be readily carried by hand, and which contains a reasonable supply of fuel, e.g. of the order of five or ten liters. Then, the user need only visit a gasoline or fuel supply station at reasonably spaced intervals to fill up the gasoline holding container or can.

Now, a problem arises in transferring fuel from the gasoline supply container to the fuel tank of the machine. The fuel tank of the machine is usually of relatively small capacity, and often has a relatively small filling port. Further, in the case of some machines, access to the filling port is at least partially obstructed by other parts of the machine. To overcome this, many commercially available fuel containers are provided with a spout, which often includes some sort of a filter to filter at least coarser contaminants from the fuel before it is supplied to the machine. In a common arrangement, a nozzle is held on by a threaded collar engaging a threaded neck of the fuel holding container. In use, the user has to first unscrew this collar to remove some sort of sealing or closure disc, and the collar and nozzle are then reattached to the container. The nozzle of the container is then inserted into the gasoline tank and fuel transferred from the fuel can or container to the fuel tank of the machine. When the operation is complete, again the nozzle and collar have to be removed and the closure or sealing disc replaced, following which the collar and nozzle are reattached to securely close the fuel holding container. It is also here noted that fuel containers usually include a separate vent opening which has to be opened and closed before and after use. It is necessary to go through this procedure, since gasoline fuel is highly volatile, and thus the container must be securely closed to prevent evaporation of the fuel.

A further difficulty arises due to the small ports of machine fuel tanks and their often awkward placement. Particularly when the fuel container is full, it can be impossible for the user to insert the nozzle of the fuel container into the fuel tank, before fuel starts to flow out of the nozzle. As such, the user has to judge the flow from the nozzle and aim it into the small inlet port of the fuel tank. Frequently, this results in spillage of fuel, which in many circumstances can be extremely hazardous and dangerous.

Proposals have been made for overcoming these problems. Thus, there are available replacement spouts for fuel containers or cans, which include an integral valve. Examples of products available in Canada are a non-spill gas can spout marketed by Perfection Automatic Products of Windsor, Ontario, Canada and a "safe-spill, no-spill" safety spout marketed by Scepter of Toronto, Canada. Both of these gas can spouts provide a valve in the spout itself remote from the sealing surface between the spout and the neck of the container. As a consequence, separate sealing surfaces and sealing gaskets or washers have to be provided for the seal between the nozzle and container neck and the seal between the parts of the valve.

Further, in neither of these products is the nozzle capable of disassembly. Thus, if the nozzle becomes clogged, it is difficult to clear it. Also, replacement of the sealing member of the valve is virtually impossible. A further consequence of this is that the whole nozzle assembly has to be small enough to be inserted through the collar that attaches to the neck of the fuel container, thereby restricting the size of the nozzle, if the nozzle is to be interchangeable between the collars of different containers. It is highly desirable that the nozzle should be interchangeable between different collars, since there is no standard collar size or thread.

SUMMARY OF THE PRESENT INVENTION

Accordingly, it is desirable that a replacement spout for a gas can should be of simple, robust construction, with as few components as possible. Further, it is preferable for it to be capable of being dismantled, so that obstructions etc. can be cleared from it, and so that its external dimensions are not limited to the opening in a collar of a fuel container.

In accordance with a first aspect of the present invention, there is provided a nozzle for a liquid container, which nozzle comprises: a first nozzle part including a flange for engaging a collar; a sealing member abutting the flange and including a first sealing surface for abutting a neck of a container and a second sealing surface; a second nozzle part including an outlet opening and slidably engaging the first nozzle part; spring biasing means acting between the first and second nozzle parts and urging the second nozzle part away from the flange of the first nozzle part; and a valve member secured to the second nozzle part and including a closure member adapted to abut the second sealing surface under the action of the spring means whereby, in use, the second nozzle part and the valve member can be displaced towards the flange and first nozzle part against the action of the spring means, to displace the closure member away from the second sealing surface, to permit fluid flow through the nozzle.

In accordance with another aspect of the present invention, there is provided a nozzle for a liquid container, the nozzle comprising: a first nozzle part including a flange for engaging a collar; a first sealing member, for providing a seal between the flange and a neck of a fluid container; a second nozzle part slidably engaging the first nozzle part; spring biasing means acting between the first and second nozzle parts and urging the second nozzle part away from the flange of the first nozzle part, the second nozzle part including a first catch surface; a valve member including a second catch surface abutting the first catch surface to secure the valve member to the second nozzle part, the valve member including a closure member; means enabling the first and second catch surfaces to be disengaged manually to disassemble the nozzle; and a second sealing member located between the closure member and the first nozzle part, so as to close off the nozzle under the action of the spring biasing means, the second nozzle part and the valve member being displacable against the action of the spring biasing means to displace the closure member away from the second sealing member to open the nozzle.

BRIEF DESCRIPTION OF THE DRAWINGS

For a better understanding of the present invention and to show more clearly how it may be carried into effect, reference will now be made, by way of example, to the accompanying drawings, in which.

DESCRIPTION OF THE PREFERRED EMBODIMENT

Figure 1:
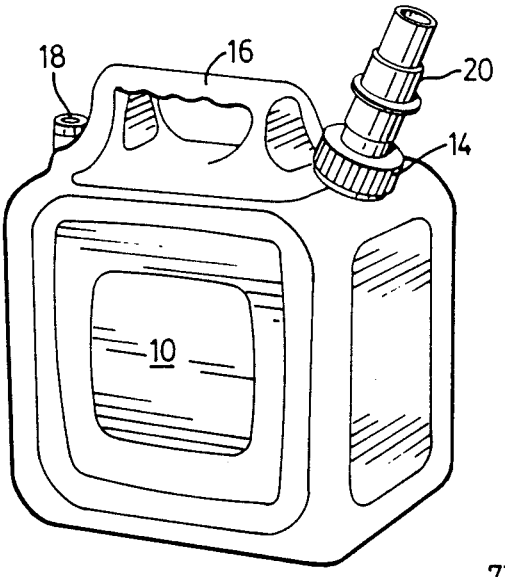
FIG. 1 is a perspective view of a fluid container including a nozzle according to the present invention.

Referring first to FIG. 1, there is shown a fluid container, generally designated by the reference 10. The fluid container 10 includes a neck 12 (FIGS. 3 and 4) provided with a screw thread. A collar 14 is mounted on this neck 12 in known manner. The container 10 further includes a handle 16 and on the other side of the handle 16 a closable air vent 18, in known manner. As discussed above, one of the principal applications of the present invention is expected to be for containers holding gasoline or other fuel, and in the following description the container 10 is described as a gasoline container. It will be appreciated that the nozzle of the present invention is applicable to a wide variety of containers dispensing a wide variety of different liquids.

Figure 2:
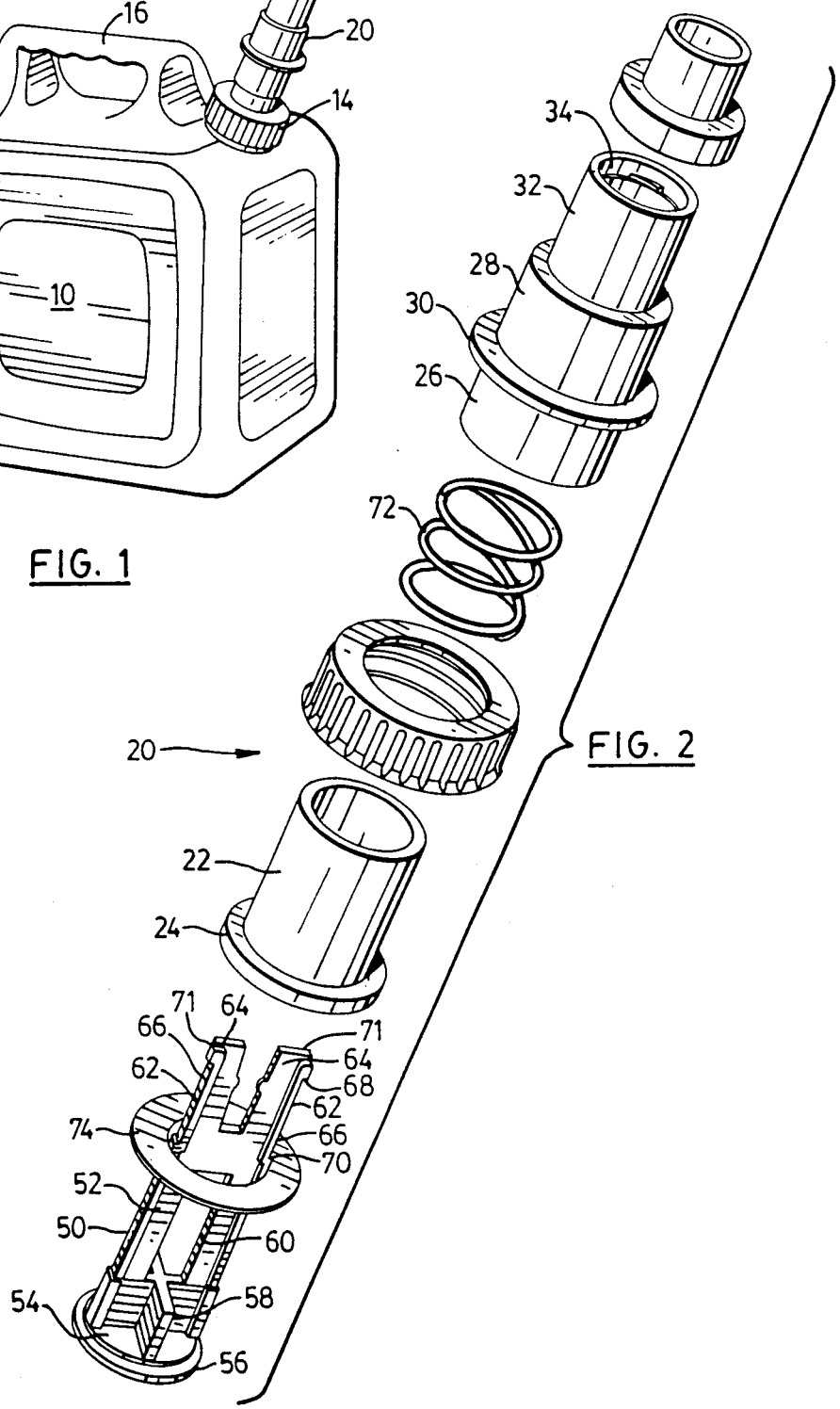
FIG. 2 is a perspective, exploded view of components of the nozzle according to the present invention.

Referring now to FIG. 2, there is shown, in an exploded view, the various components of a nozzle according to the present invention, the nozzle being designated by the reference 20. The nozzle 20 includes a first nozzle part 22, which is in the form of a cylinder with a flange 24 at its lower end.

A second nozzle part 26 is slidably mounted on the first nozzle part 22. The second nozzle part 26 includes a main cylindrical portion 28, provided with an outwardly extending annular flange 30. Extending from the main cylindrical portion 28 is a second cylindrical portion 32, which defines a discharge outlet or outlet opening 34.

Figures 3, 4, 5, 6:
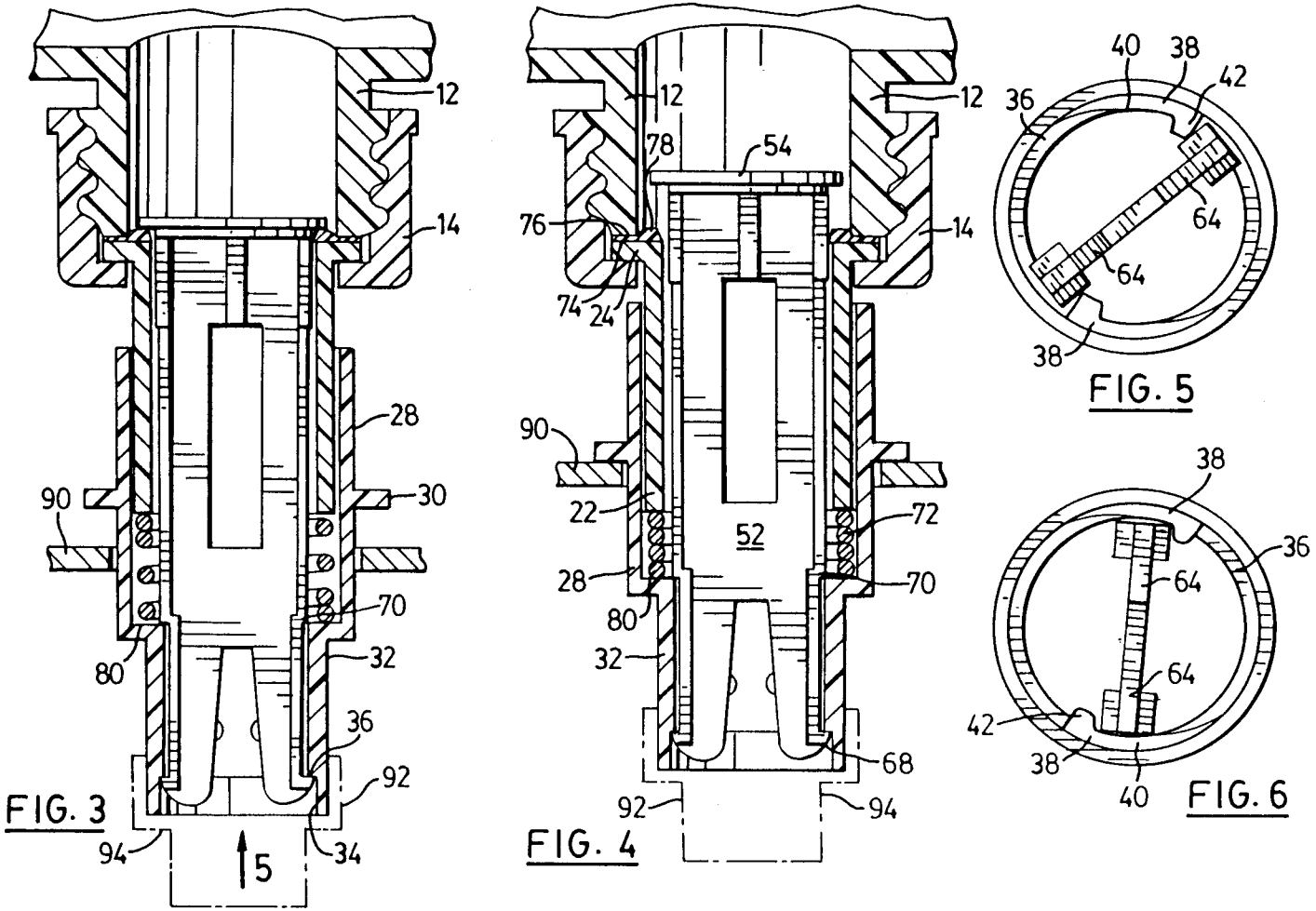
FIG. 3 is a cross-sectional view of the nozzle and the neck of the fluid container of FIG. 1 shown in a closed position.
FIG. 4 is a cross-sectional view similar to FIG. 3 in an open position.
FIGS. 5 and 6 are views along the axis of the nozzle in the direction of arrow 5 of FIG. 3, showing how it is disassembled.

As also shown in FIGS. 3–6, towards the discharge outlet 34, the second portion 32 is provided with an annular ledge 36, which forms a first catch surface. As shown in FIGS. 5 and 6, a pair of diametrically opposed disengagement cams 38 are provided. Each disengagement can 38 comprises a ramp surface 40 and a stop 42, the ramp surface 40 following a spiral path between the inside and outside of the first catch surface 36.

A valve member is denoted by the reference 50. The valve member 50 comprises a planar portion 52. The lower end of the planar portion 52 is integral with a circular closure member 54. The circular closure member 54 includes an annular sealing surface 56 stepped down from the main part of the circular closure member 54. A strengthening portion 58 extends perpendicularly to the planar portion 52.

The planar portion 52 defines a rectangular opening 60. Either edge of the planar portion 52 is thickened as indicated at 62.

The upper part of the planar portion 52 is formed as two separate arms 64. For each arm 64, the corresponding thickened edge 62 has a setback portion 66. Each setback portion 66 is terminated at the top by a second catch surface 68 and at the bottom by an abutment surface 70. As indicated at 71, the outer corners of the arms 64 are rounded or tapered to enable them to slide into the second cylindrical portion 32, whilst being pressed together.

The nozzle 20 includes a helical compression spring 72, for urging the first and second nozzle parts 22, 26 apart. The spring 72 acts between an end of the first nozzle part 22 and a shoulder 80 between the cylindrical portions 28, 32 of the second nozzle part 26.

Further, an annular sealing member 74 is provided. The annular sealing member, as shown in FIGS. 3 and 4, has a planar sealing surface which abuts the flange 24 of the first part 22. The other side of the sealing member 74 has a first annular sealing surface 76 around the outer periphery thereof. Around the inner periphery thereof, it has a second, annular sealing surface 78. The sealing member 74 is thicker for the second sealing surface 78.

Each of the first nozzle part 22, second nozzle part 26 and valve member 50 are moulded out of a plastics material. In the case of the valve member 50, the material should be such as to give a desired degree of resiliency to the arms 64.

Now, turning to the assembly and disassembly of the nozzle and its mode of use, the assembly is described first. The annular sealing member 74 is mounted on the valve member 50 and this is then inserted through the first nozzle part 22 and the spring 72. The collar 14 is then placed around the first nozzle part 22. The collar 14 may be the collar provided with a container 10, or it may be a special collar 14 provided with the nozzle assembly 20 of the present invention. With the collar 14 in place, the second nozzle part 26 is inserted over the valve member 50. The tapered ends 71 engage the bore of the cylindrical portion 32 and resiliently press the arms 64 inwards. When the second nozzle part 26 is fully engaged, as shown in FIG. 3, the arms 64 spring outwards so that the second catch surfaces 68 engage the first catch surface 36. It should be noted that it is essential for the second catch surfaces 68 to engage the first catch surfaces 36 remote from the disengagement cams 38, to ensure proper engagement; this is readily achieved by simply looking in the direction of arrow 5 of FIG. 3. As FIG. 3 also clearly shows, when fully engaged, the abutment surfaces 70 engage the shoulder 80 formed between the cylindrical portions of the second nozzle part 26. The valve member 50 is thus secured to the second nozzle part 26.

During the insertion process, the compression spring 72 is compressed, so that it is urging the first and second nozzle parts 22, 26 apart. As a consequence, the sealing member 74 is clamped between the flange 24 of the first nozzle part 22 and the annular sealing surface 56, to maintain the nozzle 20 closed.

The nozzle 20 is then readily fitted to the neck 12 of a fluid container by screwing on the collar 14 in known manner, to give the assembled configuration shown in FIG. 3. Here, the first annular sealing surface 76 is trapped between the flange 24 and the neck 12. Consequently, the container 10 is maintained in a closed position. In use, to fill up a gas tank, the air vent 18 would be opened, if required, depending upon its design. The nozzle 20 is then inserted into an opening of a gas tank, indicated at 90 in FIGS. 3 and 4. Note that at this time, the nozzle 20 is still closed, so that there should be no accidental spillage of fuel before the nozzle is inserted into the opening 90. FIG. 3 shows the nozzle 20 as it is being inserted. The outwardly extending annular flange 30 is pressed against the gas tank as shown in FIG. 4. This causes the compression spring 72 to be further compressed, and the first and second nozzle parts 22, 26 urged towards one another. As a result, the closure member 54 is displaced from the second annular sealing surface 78 thereby opening the nozzle 20. Fuel can then freely flow through the nozzle 20 into the gas tank, whilst displaced air can similarly readily flow in the opposite direction.

When the filling operation is complete, pressure on the nozzle 20 is released, permitting the spring 72 to return the closure member 54 into abutment with the second sealing surface 78. The fluid container 10 with the nozzle 20 attached can then be removed without spillage of fuel.

One advantage of the nozzle 20 is that it can be dismantled, and hence the outer dimensions of the second nozzle part 26 can be greater than the opening in the collar 14. This in turn means that the whole internal dimensions of the nozzle 20 can be relatively large, permitting rapid filling of a gas tank. The second nozzle part 26 has effectively two parts that can be pressed against a gas tank opening, namely the outer surface of the shoulder 80 between the two cylindrical portions thereof, or the outwardly extending annular flange 30. In FIGS. 3 and 4, the flange 30 is shown abutting the gas tank opening.

For smaller gas tanks, an adaptor 92 (shown in ghost outline in FIGS. 3 and 4) can be mounted on the end of the second nozzle part 26. It has a portion of one diameter for mounting on the free end of the second nozzle part and another portion of smaller diameter, so as to provide a smaller shoulder 94 for abutting the opening of small gas tanks, e.g. of small chain saws etc.

The nozzle 20 can be readily disassembled. This is achieved by inserting a pair of fingers into the discharge port 34 and twisting the arms 64 clockwise, until they engage the disengagement cams 38. This procedure is shown in FIGS. 5 and 6. As the tips of the arm 64 ride over the ramp surfaces 40, they are resiliently displaced inwards, until the first and second catch surfaces 36, 68 are fully disengaged. The valve member 50 can then be removed, permitting the whole nozzle 20 to be dismantled. This enables the nozzle 20 to be cleared of obstructions, or for example, cleaned if it is to be used for a different type of liquid. It also enables the sealing member 74 to be replaced.

As clearly shown in FIGS. 3 and 4, the sealing member 74 performs a dual function. Its outer annular sealing surface 76 provides a seal between the first nozzle part 22 and the neck 12. Its second sealing surface 78 provides a seal between the first nozzle part 22 and the closure member 54. As the collar 14 enables a relatively high clamping force to be applied to the first annular sealing surface 74, this is relatively thin. On the other hand, as a lower force is applied to form a seal with the second sealing surface 78, this is made thicker, to give it greater resiliency and sealing capability.

Whilst the applicant is not aware of any standard for gas containers, in North America the necks and collars of many gas containers, even if not identical, fall within a fairly narrow range of sizes. Accordingly, it is preferred for the first nozzle part 22 and the sealing member 74 to be so dimensioned as to accept common sizes of collars and necks available. As the nozzle can be dismantled, an existing collar can be used without having to provide a special collar.

As an alternative to resilient arms, the valve member can be largely rigid. Then, the second nozzle part would include diametrically opposed slots along which the catch surface portions of the valve member could slide. When fully engaged, the valve member would be rotated to engage the first and second catch surfaces. The first catch surface could include small projections over which the second catch surfaces would ride to lock the second nozzle part and nozzle member together.

The nozzle could be provided in a number of different colours, to provide colour coding for different liquids.

I claim:

1. A nozzle for a liquid container, which nozzle comprises: a first nozzle part including a flange for engaging a collar; a sealing member abutting the flange and including a first sealing surface for abutting a neck of a container and a second sealing surface; a second nozzle part including an outlet opening and slidably engaging the first nozzle part; spring biasing means acting between the first and second nozzle parts and urging the second nozzle part away from the flange of the first nozzle part; and a valve member secured to the second nozzle part and including a closure member adapted to abut the second sealing surface under the action of the spring means, whereby, in use, the second nozzle part and the valve member can be displaced towards the flange and the first part valve part against the action of the spring means, to displace the closure member away from the second sealing surface, to permit fluid to flow through the nozzle.

2. A nozzle as claimed in claim 1, wherein the sealing member is generally annular and includes a first, outer annular sealing surface for abutting the neck of a container, and a second, inner annular sealing surface for abutting the closure member, the sealing member having different thicknesses for the first and second annular sealing surfaces.

3. A nozzle as claimed in claim 2, wherein the sealing member includes a planar sealing surface which abuts the flange of the first valve member and said first and second annular sealing surfaces on the other side thereof, the thickness of the sealing member being greater for the second annular sealing surface than for the first annular sealing surface.

4. A nozzle as claimed in claim 1, wherein the second nozzle part includes a first catch surface and the valve member includes a second catch surface abutting the first catch surface to secure the valve member to the second nozzle part, and wherein the nozzle includes means enabling the first and second catch surfaces to be disengaged manually to disassemble the nozzle.

5. A nozzle as claimed in claim 4, wherein the disengagement means comprises resiliency in one of the second nozzle part and the valve member permitting the first and second catch surfaces to be resiliently displaced away from one another.

6. A nozzle as claimed in claim 5, wherein the first catch surface comprises an annular ledge of the second nozzle part, and the valve member includes a pair of arms each of which bears a second catch surface at a free end thereof, the free ends of the arms being resiliently displacable towards one another to enable the second catch surfaces to be displaced radially inwards and disengaged from the first catch surface.

7. A nozzle as claimed in claim 6, wherein the annular ledge of the second valve member includes a pair of diametrically opposed disengagement cams, each provided with a ramp surface extending between inner and outer edges of the annular ledge, for causing disengagement of the first and second catch surfaces.

8. A nozzle as claimed in claim 7, wherein each disengagement cam includes a stop at the end thereof having the radially innermost portion of the ramp surface.

9. A nozzle as claimed in claim 6, 7 or 8, wherein each arm of the valve member includes an abutment facing a corresponding first catch surface, for abutting the second valve member to secure the valve member therein.

10. A nozzle as claimed in claim 7, wherein the sealing member comprises a planar sealing surface on one side thereof abutting the flange of the first nozzle part, and on the other side thereof a first, outer annular sealing surface and a second, inner sealing surface, with the thickness of the sealing member being greater for the second annular sealing surface than for the first annular sealing surface, the first annular sealing surface being for abutting the neck of a container and the second annular sealing surface abutting the closure member.

11. A nozzle as claimed in claim 10, wherein the first nozzle part includes a cylindrical part, and wherein a second nozzle part includes a first cylindrical portion slidably engaging the first nozzle part on the exterior thereof, and a second cylindrical portion extending from the first cylindrical portion and of smaller diameter so as to define an annular shoulder therebetween, and wherein the spring biasing means comprises a compression spring mounted between the first nozzle part and the shoulder of the second nozzle part.

12. A nozzle as claimed in claim 11, wherein each of the arms includes an abutment which abuts the annular shoulder of the second nozzle part.

13. A nozzle as claimed in claim 11 or 12, wherein the second nozzle part includes an outwardly extending annular flange, for enabling the second nozzle part to be pressed toward the first nozzle part.

14. A nozzle as claimed in claim 13, which includes a removable adapter having a portion of a first diameter mountable on the free end of the second nozzle part and a portion of a smaller diameter, to define an annular shoulder of small diameter therebetween.

15. A nozzle as claimed in claim 2, 8 or 10, wherein the second nozzle part includes an outwardly extending annular flange, for enabling the second nozzle part to be pressed toward the first nozzle part.

16. A nozzle for a liquid container, the nozzle comprising: a first nozzle part including a flange for engaging a collar; a first sealing member, for providing a seal between the flange and a neck of a fluid container; a second nozzle part slidably engaging the first nozzle part; spring biasing means acting between the first and second nozzle parts and urging the second nozzle part away from the flange of the first nozzle part, the second nozzle part including a first catch surface; a valve member including a second catch surface abutting the first catch surface to secure the valve member to the second nozzle part, the valve member including a closure member; disengagement means enabling the first and second catch surfaces to be disengaged manually to disassemble the nozzle; and a second sealing member located between the closure member and the first nozzle part, so as to close off the nozzle under the action of the spring biasing means, the second nozzle part and the valve member being displacable against the action of the spring biasing means to displace the closure member away from the second sealing member to open the nozzle.

17. A nozzle as claimed in claim 16, wherein the first catch surface comprises an annular ledge of the second nozzle part facing away from the first nozzle part, and wherein the valve member is generally planar and includes a pair of diametrically opposed second catch surfaces at a free end thereof, for abutting diametrically opposed parts of the first catch surface.

18. A nozzle as claimed in claim 17, wherein the valve member includes a pair of resilient arms at a free end thereof extending away from the first nozzle part, with the second catch surfaces being provided at the free ends of the resilient arms to be displacable radially inwards from the first catch surface, and wherein the first catch surface includes a pair of disengagement cams, each of which includes a ramp surface inclined between inner and outer edges of the first catch surface.

19. A nozzle as claimed in claim 18, wherein each disengagement cam includes a stop at the end thereof having the radially innermost portion of the ramp surface.

20. A nozzle as claimed in claim 17, 18 or 19, wherein the second nozzle part includes a shoulder facing the first nozzle part, and wherein the valve member includes abutments abutting that shoulder, to secure the valve member to the second nozzle part.

* * * * *